US007247353B2

(12) United States Patent
Persson

(10) Patent No.: US 7,247,353 B2
(45) Date of Patent: Jul. 24, 2007

(54) METHOD AND APPARATUS FOR APPLYING A COATING ON A THREE DIMENSIONAL SURFACE

(75) Inventor: Lars Persson, Degerberga (SE)

(73) Assignee: Nolato AB, Torekov (SE)

( * ) Notice: Subject to any disclaimer, the term of this patent is extended or adjusted under 35 U.S.C. 154(b) by 31 days.

(21) Appl. No.: 10/520,234

(22) PCT Filed: Jul. 9, 2003

(86) PCT No.: PCT/SE03/01190

§ 371 (c)(1),
(2), (4) Date: Jul. 15, 2005

(87) PCT Pub. No.: WO2004/007094

PCT Pub. Date: Jan. 22, 2004

(65) Prior Publication Data

US 2006/0051518 A1 Mar. 9, 2006

(30) Foreign Application Priority Data

Jul. 10, 2002 (SE) ..... 0202166

(51) Int. Cl.
*B05D 1/04* (2006.01)
*B05B 1/025* (2006.01)

(52) U.S. Cl. ..... 427/466; 427/475; 118/624; 118/638

(58) Field of Classification Search ..... 427/466, 427/475; 118/624, 638
See application file for complete search history.

(56) References Cited

U.S. PATENT DOCUMENTS

| | | | | |
|---|---|---|---|---|
| 3,182,103 | A * | 5/1965 | Blaylock, Jr. et al. | 264/439 |
| 4,695,848 | A | 9/1987 | Padalino | |
| 5,741,558 | A | 4/1998 | Otani et al. | |
| 6,399,143 | B1 * | 6/2002 | Sun et al. | 427/2.14 |
| 6,506,456 | B1 * | 1/2003 | Sharma et al. | 427/466 |

FOREIGN PATENT DOCUMENTS

| | | |
|---|---|---|
| DE | 36 11 729 A | 10/1987 |
| GB | 2 351 682 A | 1/2001 |
| JP | 9-254392 A | 9/1997 |
| JP | 11-254706 | 9/1999 |

* cited by examiner

*Primary Examiner*—Fred J. Parker
(74) *Attorney, Agent, or Firm*—Frommer Lawrence & Haug LLP; Ronald R. Santucci

(57) ABSTRACT

A method and a device for contactless application of a coating on a three dimensionally distributed surface (14;24;34;44;54;74;84;104). The method comprises application of electrically charged particles (15;25;35;55;65;75;85;105) in such positions on said surface as to form a predetermined pattern, by guiding each of said particles individually to a predetermined position on said surface. The guiding is made by means of an adjustable electric field (12;22;32;42;52;72;82;102) having flux lines with a longitudinal direction extending through said surface, whereby said particles form said coating according to said predetermined pattern on said surface.

29 Claims, 6 Drawing Sheets

METHOD AND APPARATUS FOR APPLYING A COATING ON A THREE DIMENSIONAL SURFACE

This is a 371 filing of International Patent Application No. PCT/SE2003/001 190 filed Jul. 9, 2003 and published on Jan. 22, 2004 under publication number WO 2004/007094 A and claims priority benefits from Swedish Patent Application No. 0202166-5 filed Jul. 10, 2002.

TECHNICAL FIELD OF THE INVENTION

The present invention relates to a device and a method for contactless application of a coating on a three dimensionally distributed surface.

BACKGROUND OF THE INVENTION

Decoration or coating of products with texts and images is commonly made in a wide variety of industries. However, decoration is mostly made in two dimensions, i.e. a two dimensional decoration such as a two dimensional image is applied on a flat surface of a product. Three dimensional decoration on three dimensionally distributed surfaces of products is yet not so common.

In industry, the today most commonly used methods for decoration in three dimensions of medium sized products such as consumer electronics or toys with texts and images are indirect in that a decoration is first printed on a film, whereafter the film is applied on a product so that the decoration adhers to the product. These methods have some disadvantages though, of being complex, slow and expensive.

Some methods for printing a decoration directly on a non-planar, three dimensionally distributed surface, without first printing the decoration onto a film, have been developed.

In U.S. Pat. No. 5,831,641 is described a method for three dimensional printing with inkjet. The idea of this method is to print on a three dimensional surface of an object by using a positioning apparatus which functions to automatically maintain the surface of the object within a plan substantially parallell to and slightly spaced apart from the place within which the inkjet nozzles of the ink-jet plotter reside. This is a straightforward printing method, but it requires advanced positioning mechanics if the shape of the surface is complicated.

U.S. 2001/0019340 A1 describes another method for three dimensional printing with inkjet. In this method, the surface of a printing object is divided into a plurality of target areas, each of which is then approximated by a two dimensional projective plane. An inkjet printhead then prints a projected part image on each target area while moving in parallell with the projective planes. This method decreases the need for positioning mechanics, but introduces the problem with image deterioration owing to the inclination of the object surface in relation to the projective planes and the printhead.

In GB 2351682 A1 there is described an apparatus and a method of spraying a coating, typically a paint, on a selected surface region of an insulating or poorly conducting substrate, such as the base of a bottle, vessel or other receptacle. Sprayed coating material is attracted to the selected surface region by an electrostatic field, which is established by an electrode means and passes through the selected surface region. A conducting member in the form of a plate is disposed in the electrostatic field adjacent the selected surface region and arranged to mask the surface region of the substrate which is bordering the selected surface region. This method has the advantage over other masking arrangements that a sharp boundary between coated and uncoated areas is formed. However, the described method is suited for spraying a paint, not for printing texts and images.

A today conventional inkjet printing system for printing on a two dimensional surface is described in U.S. Pat. No. 4,695,848. According to this document, a drop generator generates ink droplets, which are first charged and then deflected by means of a pair of electrodes positioned on either side of the path followed by the droplets. The deflection is used in order to cover e.g. a whole pixel of an image or character without moving the printhead, but also in order to switch between printing and not printing. Droplets which are not supposed to hit the printing surface are deflected and collected by a gutter.

SUMMARY OF THE INVENTION

An object of the present invention is to provide an alternative and improved method and device for applying a coating on a three dimensionally distributed surface.

Another object of the present invention is to provide a method and a device for contactless application of an image on a three dimensionally distributed surface without notable image deterioration.

Another object of the invention is to provide a method and a device which eliminate the need for masking of an object surface before it is coated.

Yet another object of the invention is to provide a method and a device by means of which it is possible to coat an object surface with particles without spilling particles on ambient surfaces.

For achieving at least some of these and other objects, a method as defined in claim 1 and a device as defined in claim 18 are provided. Preferred embodiments of the invention are defined in the dependent claims.

More particularly, according to the invention, a method for contactless application of a coating on a three dimensionally distributed surface comprises applying electrically charged particles in such positions on said surface as to form a predetermined pattern, by guiding each of said particles individually to a predetermined position on said surface by means of an adjustable electric field having flux lines with a longitudinal direction extending through said surface, whereby said particles form said coating according to said predetermined pattern on said surface.

As defined herein, "coating" means all types of coating including decoration with an image, a text etc, and varnish or paint of one or several colours.

"Contactless application" of a coating is herein defined as non-impact application wherein the surface is not touched by the application means. The particles which form said coating are instead ejected from the application means into the open air and then hit the surface. Examples of contactless application are inkjet printing, air-brush and other spray-painting.

"Predetermined position on said surface" is herein defined as a position within a particular target area on said surface, wherein the target arean is determined in advance and constitutes as small part area of the surface as allowed by the particle size and the precision of the used equipment.

A "predetermined pattern" is a pattern which is determined in advance in that it makes up e.g. a text or an image which one desires to decorate the surface with.

The particles are thus guided to the surface by means of the electric field in such a way that they follow flux lines of the electric field in their path to said surface. More particularly, the particles strive for travelling in the direction of flux lines of the electric field. Since the flux lines have a longitudinal direction extending through the surface to be coated, the particles will be attracted to the surface and form said coating on the surface.

According to the invention, said particles are applied in such positions on said surface as to form a predetermined pattern. This may e.g. be achieved in a manner corresponding to the way in which a predetermined text or image is printed on a paper by a common inkjet printer. Hence, by applying the particles in predetermined positions on said surface so as to form a predetermined pattern, it is made possible to print texts and images on three dimensionally distributed surfaces. While for example spray-painting in different colours of a surface requires masking, since the position in which each "spray-particle" hits the surface is not predetermined, printing in different colours may be performed with high precision so that masking is not required.

Further, by guiding the particles to a three dimensionally distributed surface by means of an electric field, a text or image may be printed on the surface without notable image deterioration which would be due to the inclination of the surface in relation to the printhead. More particularly, the flux lines of the electric field may extend approximately perpendicular in relation to the surface, despite that the surface is inclined in relation to the printhead. Thus, the particles may impinge on the surface approximately perpendicularly so that they are not thinly spread out on the surface, which would cause image degradation resulting in a blurred image. As a consequence of this advantage, also the need for advanced positioning mechanics decreases since the printhead must not necessarily be positioned in parallell with the surface in order to achieve high precision printing and avoid image degradation.

By guiding the particles in an electrically charged state to the surface by means of an electric field, some physical laws may be taken advantage of when for example a printhead with multiple ejection nozzles is used. For the first, equally charged particles will mutually repulse each other. For the second, since different flux lines of the electric field do not cross each other, particles ejected from adjacent ejection nozzles will adopt separate, non-crossing paths towards the surface. Because of these physical laws, the risk that particles ejected from adjacent ejection nozzles collide is minimal.

In an alternative embodiment, a magnetic field is used instead of, or in combination with, said electric field in order to guide particles to a predetermined position on said surface. If a magnetic field is applied, which has magnetic flux lines with a longitudinal direction extending through the surface to be coated, and the particles comprise a magnetic material, the particles will be attracted to said surface.

According to one embodiment of the invention, said electric field is applied such that at least some of its flux lines cross said surface. In that way, the particles will follow these at least some flux lines until they impinge onto the surface.

According to another embodiment of the invention, said longitudinal direction of said flux lines extend through said surface at an angle in the interval between 60° and 120°. If the angle between the flux lines and the surface is kept within this interval, image degradation due to inclined impact of particles on the surface may be considered insignificant. However, there are many other factors, such as particle size, material characteristics etc, that will influence on the image quality.

In another embodiment, the method further comprises adjustment of the distribution of said electric field in order to control the positions in which said particles are applied on said surface. There are several ways in which the distribution of the electric field may be adjusted, and these ways may be used in order to control where on the surface the particles are applied.

In another embodiment of the invention, the method further comprises adjustment of the relative positions of a means for ejecting said particles and said surface in order to control the positions at which said particles are applied on said surface.

In yet another embodiment of the invention, the method further comprises adjustment of the relative motion of a means for ejecting said particles and said surface in order to control the positions at which said particles are applied on said surface. Not only the relative positions of the surface and the means for ejecting said particles may be considered in controlling the positions at which said particles are applied on the surface, but also their relative motion.

In another embodiment, said electric field is applied over said surface between an electrode and a means for ejecting said particles.

In a specific embodiment, said electrode in formed by an object comprising said surface. Thus, an electric potential which attracts said particles is applied directly to the surface.

In another specific embodiment, said surface is arranged between said electrode and said means for ejecting said particles. Thus, in this embodiment an electric potential which attracts said particles is applied to a separate electrode. This electrode may be positioned behind the surface in relation to the means for ejecting said particles.

In yet another specific embodiment, the method further comprises moving the position of said electrode in relation to the position of said surface in order to control the positions in which said particles are applied on said surface.

In one embodiment, said particles are in the form of viscous droplets. The viscosity may for example be in interval 5 to 25 cP. One advantage with this is that viscous droplets may easily adhere to the surface.

In another embodiment, said droplets comprise ink. As defined herein, ink means any printable material which at a given printing temperature is viscous and may be ejected from a printhead and adhere to a surface. The ink may be pigmented or have some other desired feature, such as having a varnishing effect, being reflective, being abrasion resistant, being fire resistant etc.

In yet another embodiment, said particles comprise ink.

In yet another embodiment, said particles are applied by means of inkjet printing. Prior art from the area of inkjet printing may advantageously be used to implement the present invention. For example, inkjet technologies provide high precision positioning of the particles on the surface to be coated.

According to another embodiment of the invention, said coating is an image.

According to another embodiment, the method further comprises starting from image information representing said image, and information representing said surface, transforming said image information into a compensated image information, and transfering said image in accordance with said compensated image information to said surface by means of contactless application.

Said image information representing said image may be in the form of a data file, e.g. a bitmap file, or other information structure from which information about the image may be extracted. Said information representing said surface may also be in the form of a data file or other information structure.

An image printed contactlessly from one direction on a three dimensionally distributed surface will be more or less deteriorated on all those parts of the surface that are inclined in relation to the printhead. This image deterioration consists partly of image degradation as mentioned above, but also of image distortion. Image distortion is due to that the space between pixels of the image on the surface is increased because of the inclination. In other words, the image distortion is due to nonuniform stretching of the image when applied on the 3D surface.

According to this embodiment, the distortion may be eliminated by compensating the image for the distortion before applying it on the surface. The image is herein via said compensated image information transformed into a compensated state in which the image is distorted so to say in "reversed directions" as compared to the distortion resulting by the shape of the surface. Hence, when the compensated image is applied on the surface, the image will be "un-distorted" by the shape of the surface.

According to yet another embodiment, said image information is transformed such that distortion in the form of non-uniform stretching of said image on said surface is reduced.

Further in accordance with the present invention, a device for applying a coating on a three dimensionally distributed surface is provided. The device comprises means for ejecting electrically charged particles, an electrode for forming an electric field between the electrode and said means for ejecting said particles, wherein said electric field has flux lines with a longitudinal direction extending through said surface in order to guide said particles to said surface so that they form said coating, and means for predetermining a pattern according to which said particles are arranged to form said coating.

According to one embodiment of the invention, said means for ejecting said particles is arranged to eject said particles in a direction essentially towards said surface.

According to another embodiment of the invention, said device further comprises a control means being arranged to adjust said electric field in order to control the positions in which said particles are applied on said surface.

In another embodiment of the invention, said control means is further arranged to control ejection of said particles by said means for ejecting said particles.

In another embodiment, said control means is further arranged to control the position of said surface in relation to said means for ejecting said particles in order to control the positions in which said particles are applied on said surface.

In yet another embodiment, said control means is further arranged to control the motion of said surface in relation to said means for ejecting said particles in order to control the positions in which said particles are applied on said surface.

In another embodiment, said control means further is arranged to control the position of said surface in relation to said electrode in order to control the positions in which said particles are applied on said surface.

In another embodiment of the invention, said particles are in the form of viscous droplets.

In another embodiment, said droplets comprise ink.

In yet another embodiment, said particles comprise ink.

In yet another embodiment, said means for ejecting electrically charged particles comprises an inkjet printing nozzle.

According to another embodiment of the invention, said coating is an image.

According to yet another embodiment of the invention, said device further comprises means for transforming, starting from image information representing said image and information representing said surface, said image information into a compensated image information, and means for transfering said image in accordance with said compensated image information to said surface by means of contactless application.

BRIEF DESCRIPTION OF THE DRAWINGS

The present invention will now be described in more detail with reference to the accompanying drawings, in which.

DETAILED DESCRIPTION OF PREFERRED EMBODIMENTS

Figure 1:
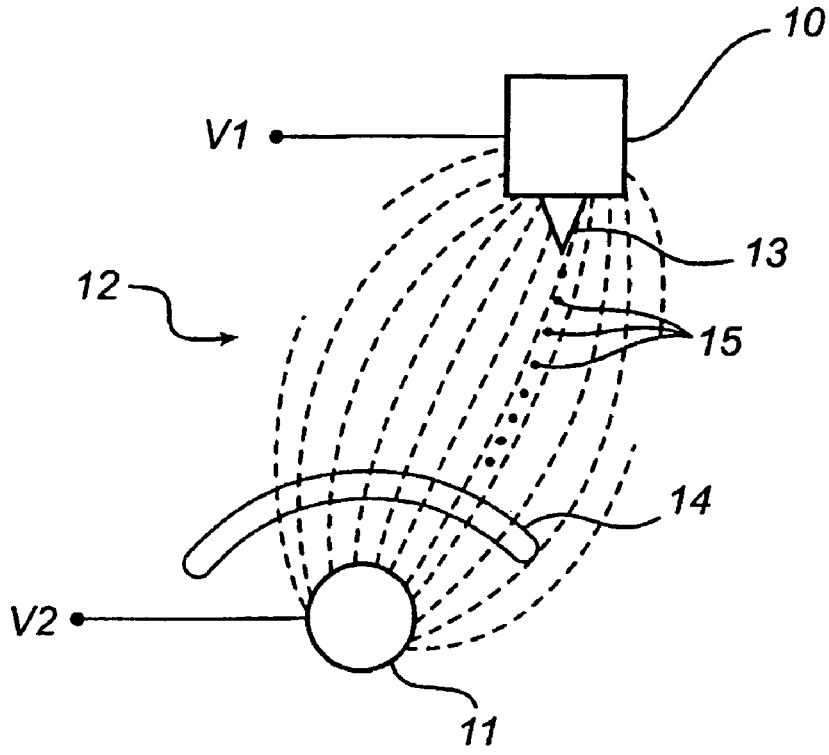
FIG. 1 is a schematic view of one embodiment of a device according to the invention, illustrating the basic principle of the invention.

FIG. 1 shows an embodiment of a device according to the invention which comprises a means for ejecting electrically charged particles, here in the form of a printhead 10, and an electrode 11 for forming an electric field 12 between the electrode 11 and the printhead 10.

The means for ejecting electrically charged particles may be in the form of a printhead of an inkjet printing device, but also other techniques by means of which it is possible to individually apply an electrically charged particle on a surface may be used.

The printhead 10 comprises an ejection nozzle 13 which is arranged to eject the electrically charged particles towards a three dimensionally distributed surface 14 to be coated. The electrically charged particles may have been charged e.g. by means of charge electrodes (not shown) or by means of electron radiation (neither shown) before they are ejected from the ejection nozzle 13.

The electrode 11 may be in the form of a sphere, as in this embodiment, or a cylinder, or have any other shape which is suitable for a specific shape of a surface to be coated.

The electric field 12 is established as a result of a difference in electric potential between, in this embodiment, the printhead 10 and the electrode 11. In FIG. 1, this is illustrated by a potential V1 of the printhead 10 and another different potential V2 of the electrode 11. If the potential V2 is higher than the potential V1, the electrically charged particles should be negatively charged so that they are attracted by the electrode 11.

In this embodiment, the electrically charged particles are in the form of electrically charged ink droplets 15.

The ink may be water-based or oil-based, solvent-based or UV-curable. It may also be an ink which changes phase from solid to liquid as a result of heating before it is ejected from the printhead. The ink may be pigmented or have some other desired feature, such as having a varnishing effect, being reflective, being abrasion resistant, being fire resistant etc.

When the three dimensionally distributed surface 14 of an object is to be coated, the electric field 12 is applied over the surface 14 so that flux lines of the electric field 12 cross the surface 14. In most cases, this means that the electrode 11 is placed behind the surface 14 in relation to the printhead 10. The ejection nozzle 13 of the printhead 10 then ejects the electrically charged ink droplets 15 towards the surface 14. The ink droplets 15, being attracted by the electrode 11, strive for travelling in the direction of flux lines of the electric field 12. Since the flux lines cross the surface 14, the ink droplets 15 will impinge on the surface 14 and together form a coating. Thus, the ink droplets 15 are guided to the surface 14 by means of the electric field 12.

Since the ink droplets 15 are guided by the electric field 12 towards the surface 14, the ejection nozzle 13 must not necessarily be directed strictly towards the surface 14. It is enough that the ink droplets 15 are ejected in a direction essentially towards the surface 14, i.e. the ejection nozzle 13 may point towards a position slightly beside the surface 14.

By adjusting the electric field 12, for example by changing the strength of it or by moving the printhead 10 in relation to the surface 14, different parts of the surface 14 may be coated with ink droplets 15.

The actual positions in which the ink droplets 15 will impinge on the surface 14 may be pre-determined by means of "trial and error". This could for example be done by applying the electric field 12 over a "test" surface 14, and then, for each position of the surface 14 to be coated, perform "test" coating in order to determine a good combination of the relative positions between the printhead 10, the electrode 11 and the surface 14 to be coated, and the strength of the electric field 12. The determined combination for each surface position may be stored in a data base so that a whole "coating session" for a specific type of coating surface may be pre-programmed and performed automatically for each following item with identical surface to be coated.

Alternatively, or additionally, the actual positions in which the ink droplets 15 will impinge on the surface 14 may be predetermined by means of simulation in a computer program.

The ejection of the ink droplets 15 may be performed in different ways. One common method to eject ink droplets is called "continuous inkjet", wherein a continuous stream of ink droplets are ejected towards the surface. Another common method to eject ink droplets is called "drop on demand", wherein droplets are ejected only when needed.

In the embodiment shown in FIG. 1, the electric field 12 is established between the printhead 10 and the electrode 11. In fact, as long as the ink droplets, being ejected from the printhead, are attracted by the electrode, the actual points between which the electric field is established is optional. Hence, the electric field may instead of extending from the printhead extend from another point in the neighbourhood of the printhead.

Further, the electrode may, instead of being a separate electrode being placed somewhere behind a surface to be coated, be formed by the object itself of which the surface to be coated is a part.

Figure 2:
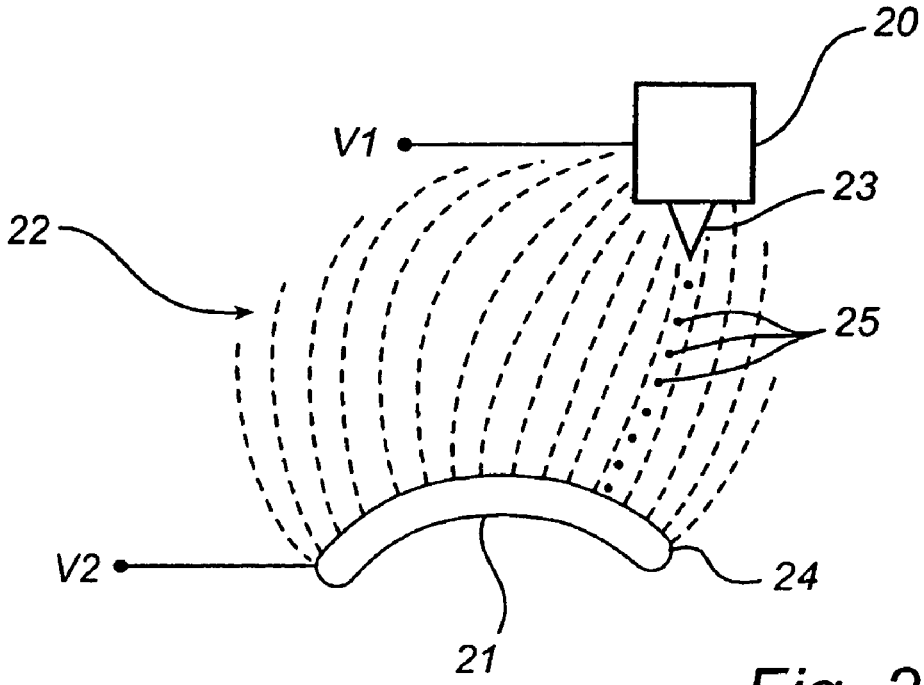
FIG. 2 is a schematic view of another embodiment of a device according to the invention, which embodiment is an alternative to the one shown in FIG. 1 and also illustrates the basic principle of the invention.

Such an alternative embodiment is shown in FIG. 2, where an electric field 22 is established between a printhead 20 and an object 21 comprising a surface 24 to be coated. In this embodiment, a potential V1 is applied to the printhead 20 and another potential V2 is applied directly to the object 21. Thereby, electrically charged ink droplets 25 ejected from an ejection nozzle 23 of the printhead 20 are attracted to the surface 24 and will strive for travelling in the direction of flux lines extending from the surface 24, until they impinge on the surface 24.

Figure 3:
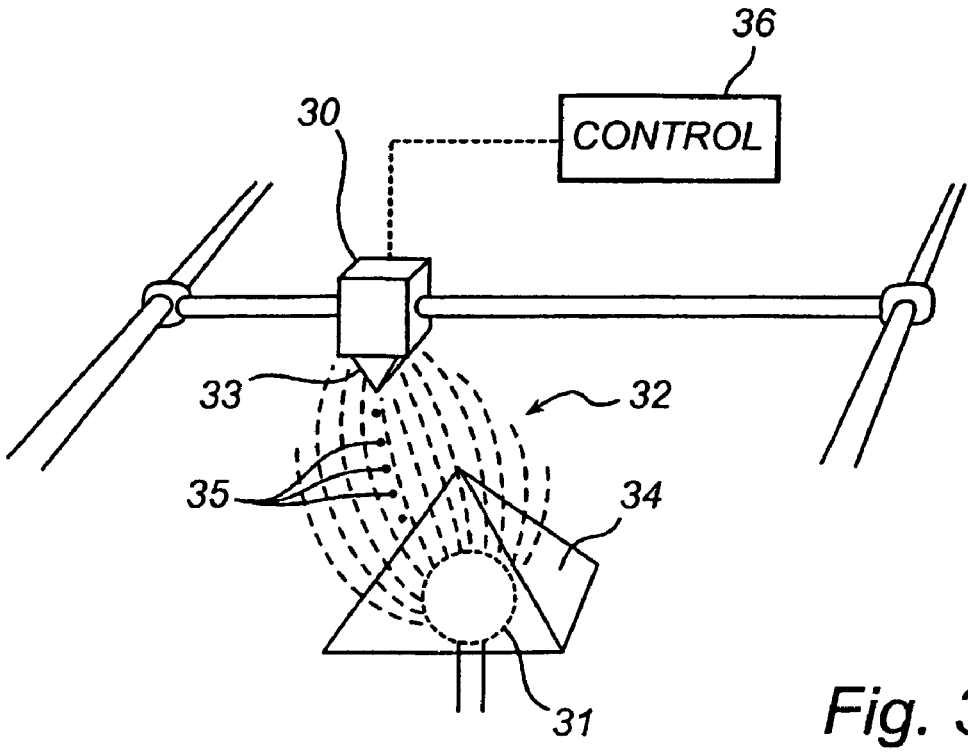
FIG. 3 is a schematic perspective view of another embodiment of a device according to the invention, illustrating means for controlling the relative positions and motion of a surface to be coated and a printhead.

In FIG. 3 is shown an embodiment of a device according to the invention comprising a means for controlling the relative positions and motion of a surface to be coated and a printhead. This "control means" may be in the form of any proper digital or analogue control device. In FIG. 3, the positions on a surface 34 in which ink droplets 35 ejected from an ejection nozzle 33 of a printhead 30 are controlled by means of a control means 36.

Irrespective of where the printhead 30 is positioned in relation to the surface 34, an electric field 32 established between the printhead 30 and an electrode 31, in FIG. 3 placed behind the surface 34 in relation to the printhead 30, will always have flux lines crossing the surface 34. Thereby, the electrically charged ink droplets 35 will be attraced towards the surface 34.

In FIG. 3, the position of the printhead 30 in relation to the surface 34 may be changed within one or two degrees of freedom (movement in one plane). Other embodiments, for more precision demanding applications, may allow movement of the printhead within three degrees of freedom (several planes in space).

Figure 4:
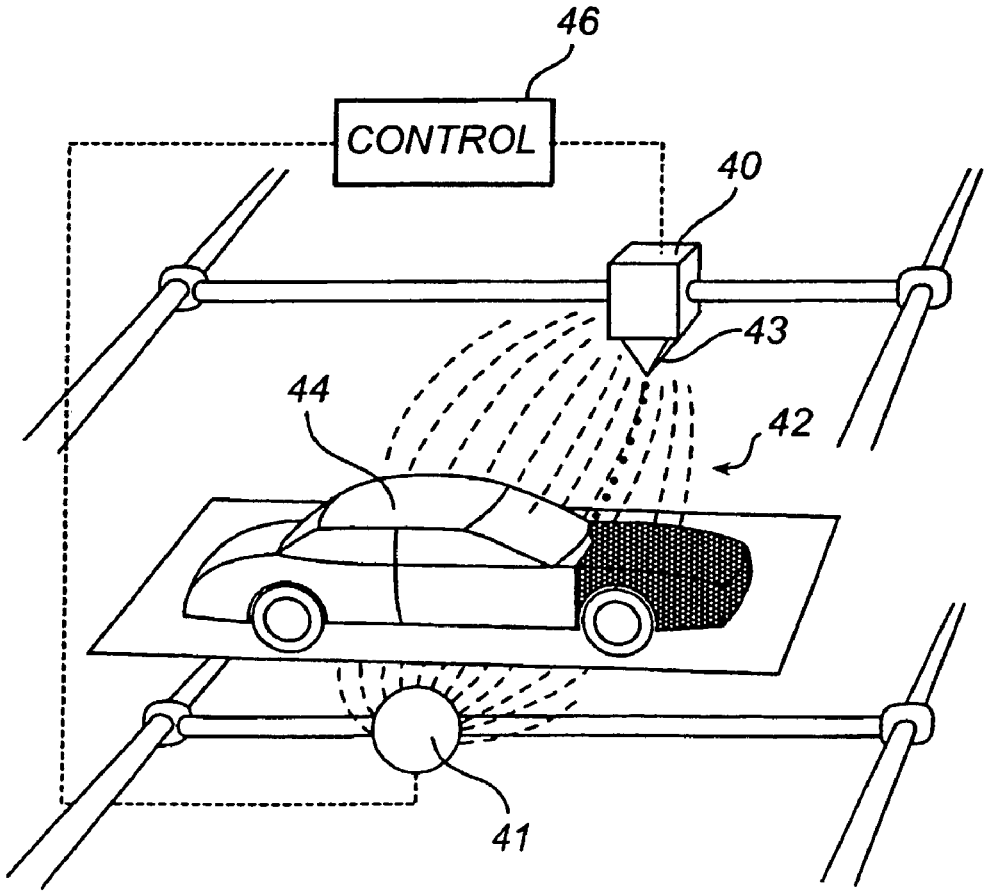
FIG. 4 is a schematic perspective view of another embodiment of a device according to the invention, illustrating means for controlling the position of a surface to be coated in relation to both an electrode and a printhead.

FIG. 4 shows another embodiment of a device according to the invention, where also the position of an electrode 41 in relation to the position of a surface 44 to be coated and a printhead 40 may be changed. The positions of the printhead 40 and the electrode 41 are controlled by means of a control means 46. Movement of the electrode 41 in relation to the surface 44, in combination with movement of the printhead 40, adds further possibilities to adjust the distribution of an electric field 42 established between the printhead 40 and the electrode 41.

Figure 5:
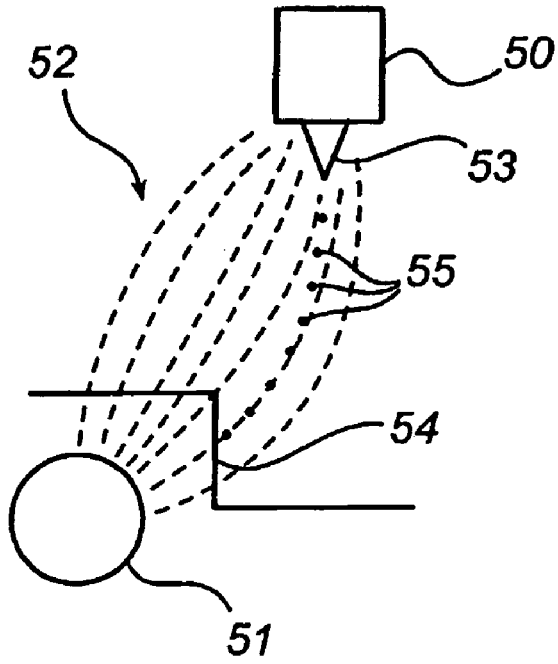
FIG. 5 is a schematic view of an embodiment of a device according to the invention, illustrating coating of a "tricky" surface.

FIG. 5 shows the possibility to apply a coating on a surface 54 which is parallell to the direction in which the ejection nozzle 53 of a printhead 50 points and ejects electrically charged ink droplets 55. By positioning the printhead 50 and an electrode 51 in proper positions, an electric field 52 between the printhead 50 and the electrode 51 may cross the surface 54 at a tolerated angle, so that the ink droplets 55 guided by the electric field 52 are not thinly spread out on the surface 54 when they impinge on it.

It is possible to adjust the electric field 52 so that the flux lines cross the surface 54 at a tolerated angle in the interval between 60° and 120°. Note that the flux lines only need to have an angle within this interval in the immediate adjacency of the surface 54. Further away from the surface the flux lines may bend towards another angle in relation to the surface 54. Note also that a crossing angle within this interval not excludes that the electric field ends in an object comprising the surface 54, nor that the flux lines continue on the other side of the surface in relation to the printhead.

When a surface to be coated instead is perpendicular to the direction in which the ejection nozzle 53 of the printhead 50 points, or just is slightly inclined, it might be so that the best impinge angle against the surface would be achieved if the ink droplets follow a straight line in the direction of the ejection nozzle 53 towards the surface. In such a case, coating may be performed with the electrode 51 being uncharged.

Figure 6:
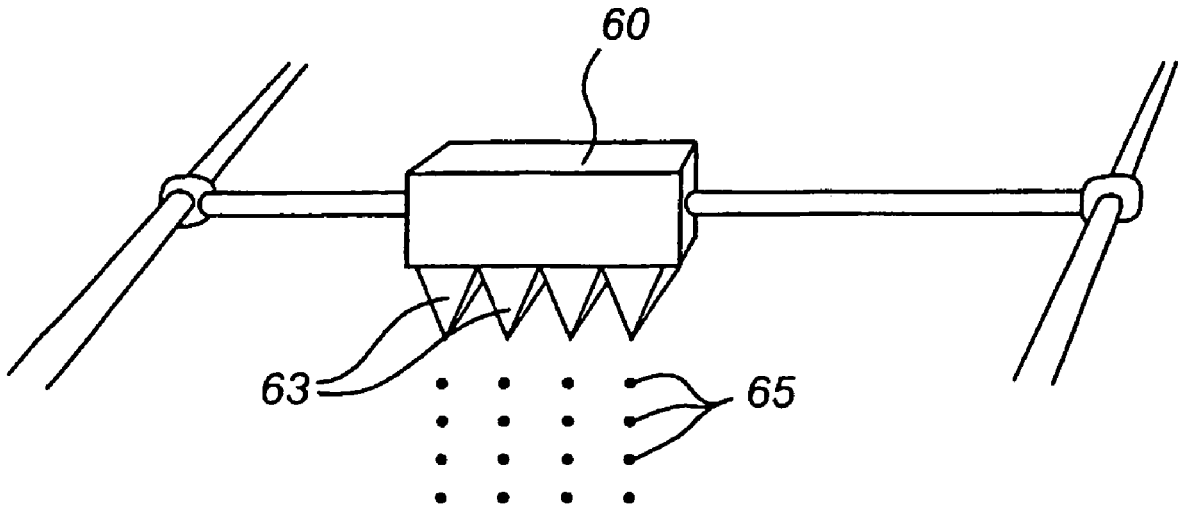
FIG. 6 is a schematic perspective view of a part of an embodiment of a device according to the invention comprising multiple ejection nozzles.

In FIG. 6 is shown a part of an embodiment of a device according to the invention where a printhead 60 comprises multiple, in this case four, ejection nozzles 63. The different ejection nozzles 63 may e.g. eject ink droplets 65 of different colours.

Figure 7A:
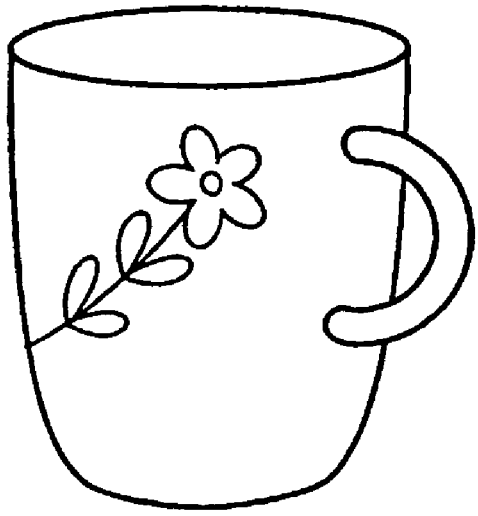
FIG. 7*a* is a schematic perspective view of a decorated cup.
Figure 7B:
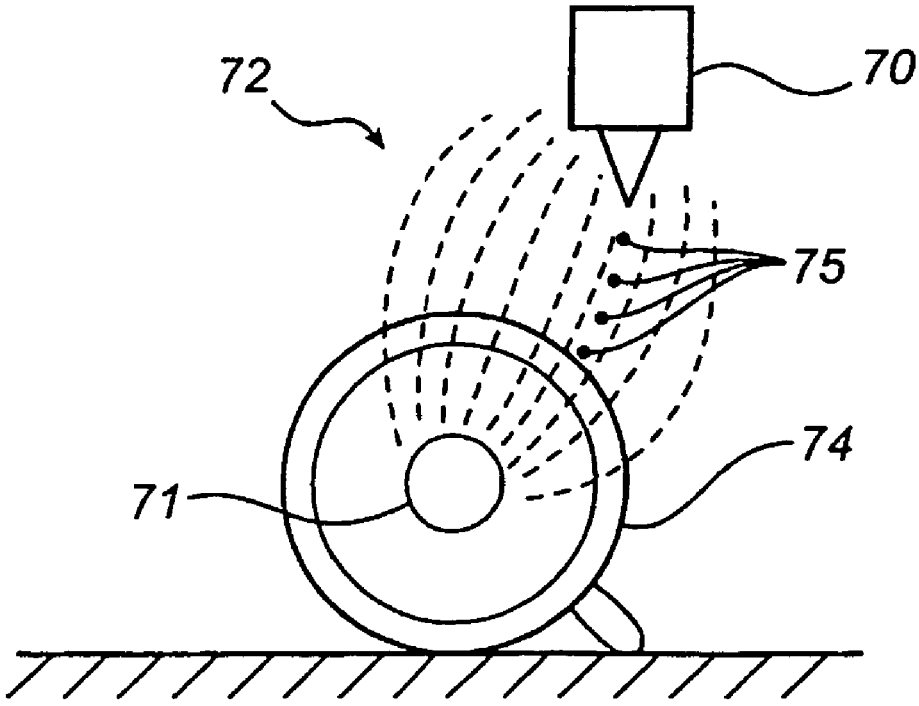
FIG. 7*b* is a schematic view illustrating decoration of the cup shown in FIG. 7*a* using a device according to the invention.

FIG. 7*a* shows a cup which is decorated with a flower. Such a decoration may be printed on a cup or another object by means of a device according to the invention. Decoration of the cup shown in FIG. 7*a* by means of an embodiment of a device according to the invention is shown in FIG. 7*b*. As illustrated, ink droplets 75 are guided to the outer surface 74 of the cup by means of an electric field 72 which is established between a printhead 70 and an electrode 71 inside the cup. A decoration pattern may be pre-programmed in a control means of the device in a similar way as ordinary inkjet printers are pre-programmed in order to print a text or a decoration on a paper.

Figure 8:
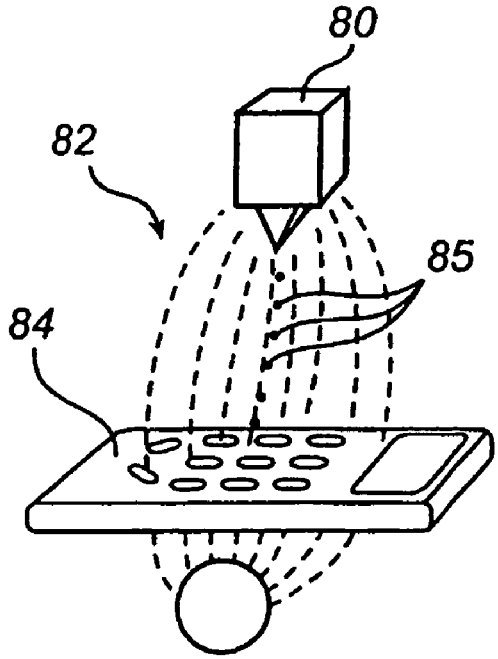
FIG. 8 is a schematic perspective view illustrating coating of a mobile phone shell using a device according to the invention.

FIG. 8 shows coating of a mobile phone shell 84 by means of a device according to the invention. Usually, product parts like mobile phone shells are coated using some spray-paint technique. However, a problem with such techniques is that not only the shell is painted, but also its environment. In this respect, a device according to the invention is advantageous. For the first, the ink droplets 85 are guided to the shell by an electric field 82 which reduces the risk that the ink droplets 85 fall somewhere else than on the shell 84. For the second, the invention may take advantage of all the common inkjet printing techniques such as high precision positioning of a printhead 80 in relation to the shell 84 and the possibility to choose "not to print" in the holes of the shell 84.

Figure 9:
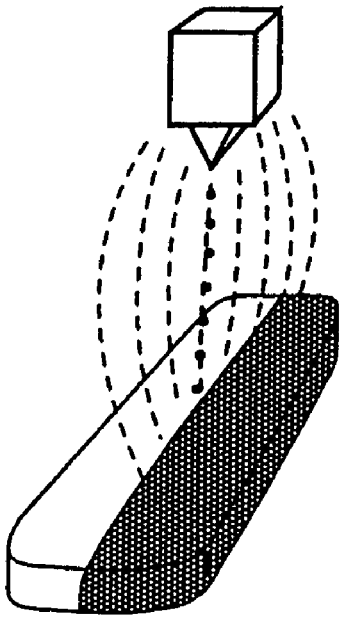
FIG. 9 is a schematic perspective view illustrating coating of a part of a surface using a device according to the invention.

FIG. 9 illustrates another advantage of coating by means of a device according to the invention in relation to coating by means of spray-painting. While spray-painting in different colours of a device requires masking, printing in different colours by using a device according to the invention may be performed with high precision so that masking is not required.

Figure 10:
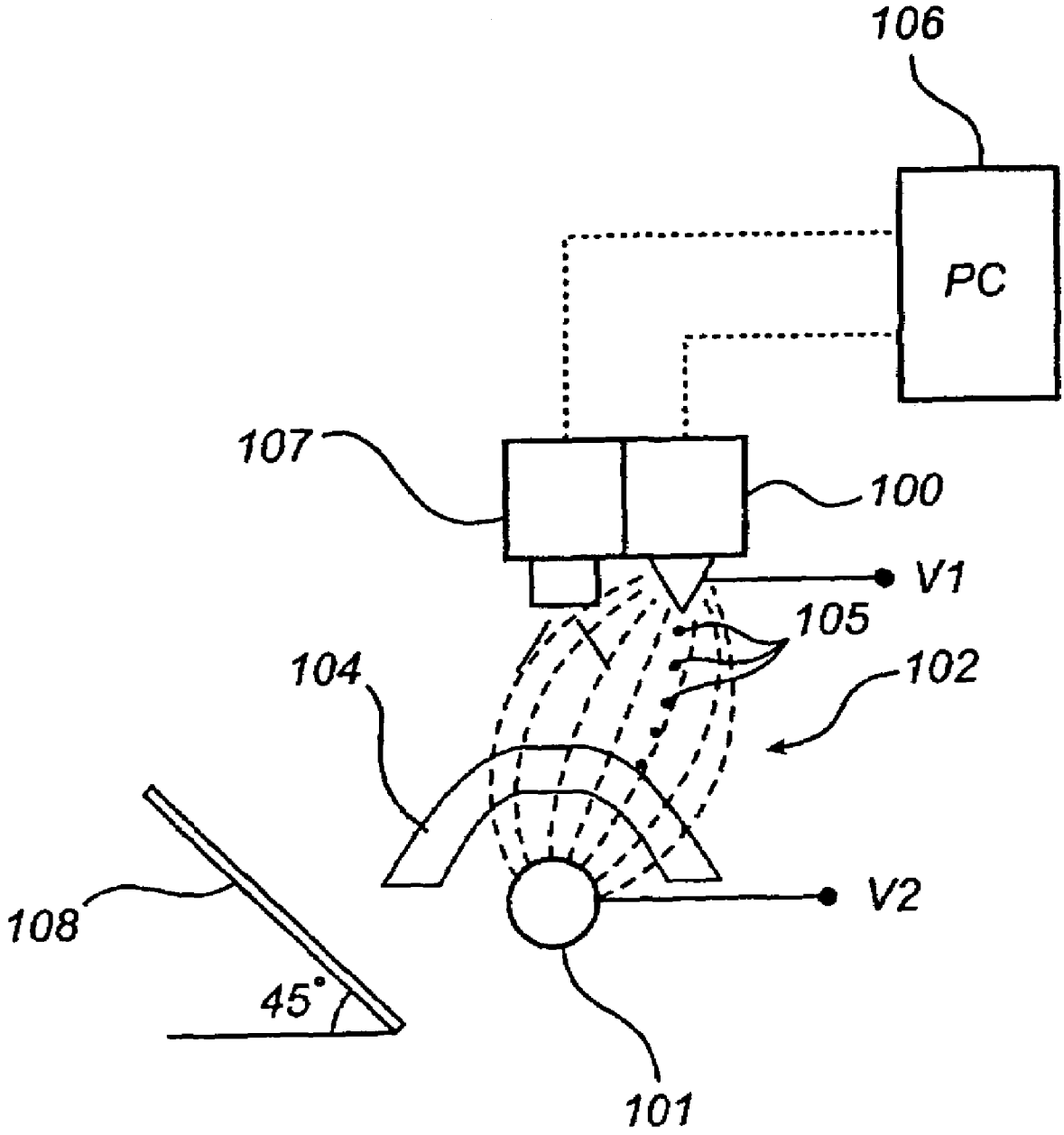
FIG. 10 is a schematic view of another embodiment of a device according to the invention.

FIG. 10 shows another embodiment of a device according to the invention which, just like the embodiment shown in FIG. 1, comprises a means for ejecting electrically charged particles, here in the form of a printhead 100, and an electrode 101 for forming an electric field 102 between the electrode 101 and the printhead 100. By adjusting the electric field 102, by changing the strength of it or by moving the printhead 100 in relation to the surface 104 to be printed, different parts of the surface 104 may be coated with ink droplets 105.

The device shown in FIG. 10 further comprises a computing device, here in the form of a personal computer (PC) 106 connected to an inkjet printer comprising the printhead 100, a means for reading a test pattern from the surface 104, here in the form of a video camera 107 with a frame grabber card which is also connected to the PC 106, and one or more mirrors 108. Instead, or in addition to, the video camera 107 a digital camera may be used.

The printhead 100 is in this embodiment first used for applying a two dimensional test pattern on the surface 104. This test pattern may for example comprise black coordinate points arranged in a bar pattern.

The test pattern is then read from the surface by means of the video camera 107 into the PC 106. The purpose of printing a test pattern onto the surface 104 is to determine the distortion of an image printed on the surface 104 due to the electric field and the inclination of the surface 104 in relation to the printhead 100. If the printed test pattern is unfolded into a two dimensional plane, this distortion may be seen as displacements of the printed, unfolded coordinate points in relation to the original coordinate points in the two dimensional plane. In order to unfold, or more specifically elastically unfold, the test pattern into the two dimensional plane, the mirror 108 may be used. By inclining the mirror 108 45° in relation to a top flat part of the surface 104, one side of the surface 104 may be unfolded into the same two dimensional plane as the top flat part lies in. This simple unfolding technique only works for simple three dimensional surface shapes. If the shape of the surface is more complicated, it may for example be scanned and then modelled and unfolded in a computer program.

The distortion of the test pattern is determined in a computer program. When this is made, a compensating pattern is calculated which compensates for the distortion. This is made by moving the original test pattern coordinates in the opposite directions compared to the distortion directions.

By means of the compensating pattern, an image that one whiches to print on the surface 104 may be transformed into a compensated state so that image distortion is reduced. This transformation may for example be done by means of an interpolation method.

A device according to the invention may also comprise other guiding electrodes than the ones shown in the illustrated examples. Further, magnetic fields may also be used in combination with electric fields in order to guide electrically charged particles to correct positions on a surface to be coated.

The present invention is applicable in a wide variety of bransches and industries. A few examples are printing or decoration of household articles, electronics, toys, sport articles, clothes, fashion articles, and labels on packages.

It is to be understood that modifications of the above described devices and methods can be made by people skilled in the art without departing from the spirit and scope of the invention.

The invention claimed is:

1. A method for contactless application of a coating on a three dimensionally distributed surface (14;24;34;44;54;74;84;104), said method comprising applying electrically charged particles (15;25;35;55;65;75;85;105) in such positions on said surface as to form a predetermined pattern, by guiding each of said particles individually to a predetermined position on said surface by means of an adjustable electric field (12;22;32;42;52;72;82;102) having flux lines with a longitudinal direction extending through said surface, whereby said particles form said coating according to said predetermined pattern on said surfaces, wherein said electric field is applied over said surface between an electrode (11;21;31;41;51;71;101) and a means (10;20;30;40;50;60;70;80;100) for ejecting said particles, adjusting the relative positions of said means (10;20;30;40;50;60;70;80;100) for ejecting said particles and said surface and said electrode (11;21;31;41;51;71;101) in order to control the positions at which said particles are applied on said surface.

2. A method according to claim 1, wherein said electric field is applied such that at least some of its flux lines cross said surface.

3. A method according to claim 1, wherein said longitudinal direction of said flux lines extend through said surface at an angle in the interval between 60° and 120°.

4. A method according to claim 1, further comprising adjusting the distribution of said electric field in order to control the positions at which said particles are applied on said surface.

5. A method according to claim 1, further comprising adjusting the relative motion of a means (10;20;30;40;50;60;70;80;100) for ejecting said particles and said surface in order to control the positions at which said particles are applied on said surface.

6. A method according to claim 1, wherein said electrode is formed by an object comprising said surface.

7. A method according to claim 1, wherein said surface is arranged between said electrode and said means for ejecting said particles.

8. A method according to claim 1, further comprising moving the position of said electrode in relation to the position of said surface in order to control the positions in which said particles are applied on said surface.

9. A method according to claim 1, wherein said particles are in the form of viscous droplets.

10. A method according to claim 9, wherein said droplets comprise ink.

11. A method according to claim 1, wherein said particles comprise ink.

12. A method according to claim 1, wherein said particles are applied by means of inkjet printing.

13. A method according to claim 1, wherein said coating is an image.

14. A method according to claim 13, wherein the method further comprises transforming information of said image into a compensated image information, and transfering said image in accordance with said compensated image information to said surface by means of contactless application.

15. A method according to claim 14, wherein said image information is transformed such that application of said image on said surface is undistorted.

16. A device for applying a coating on a three dimensionally distributed surface (14;24;34;44;54;74; 84;104), said device comprising means (10;20;30;40;50;60;70;80;100) for ejecting electrically charged particles (15;25;35;55;65;75;85;105), an electrode (11;21;31;41;51;71;101) for forming an electric field (12;22;32;42;52;72;82;102) between the electrode and said means for ejecting said particles, wherein said electric field has flux lines with a longitudinal direction extending through said surface in order to guide said particles to said surface so that they form said coating, and means for predetermining a pattern according to which said particles are arranged to form said coating, wherein said means (10;20;30;40;50;60;70;80;100) is movable in relation to said electrode (11;21;31;41;51;7l;101) and said surface (14;24;34;44;54;74;84;104) in order to control the positions at which said particles are applied on said surface.

17. A device according to claim 16, wherein said flux lines cross said surface.

18. A device according to claim 16, wherein said means for ejecting said particles is arranged to eject said particles in a direction essentially towards said surface.

19. A device according to claim 16, further comprising a control means (36;46;106) being arranged to adjust said electric field in order to control the positions in which said particles are applied on said surface.

20. A device according to claim 19, wherein said control means further is arranged to control ejection of said particles by said means for ejecting said particles.

21. A device according to claim 19, wherein said control means further is arranged to control the position of said surface in relation to said means for ejecting said particles in order to control the positions in which said particles are applied on said surface.

22. A device according to claim 19, wherein said control means further is arranged to control the motion of said surface in relation to said means for ejecting said particles in order to control the positions in which said particles are applied on said surface.

23. A device according to claim 19, wherein said control means further is arranged to control the position of said surface in relation to said electrode in order to control the positions in which said particles are applied on said surface.

24. A device according to claim 16, wherein said particles are in the form of viscous droplets.

25. A device according to claim 24, wherein said droplets comprise ink.

26. A device according to claim 16, wherein said particles comprise ink.

27. A device according to claim 16, wherein said means for ejecting electrically charged particles comprises an inkjet printing nozzle (13;23;33;43;53;63).

28. A device according to claim 16, wherein said coating is an image.

29. A device according to claim 28, further comprising means for transforming information of said image into a compensated image information, and means for transfering said image in accordance with said compensated image information to said surface by means of contactless application.

* * * * *